US006032568A

United States Patent [19]

Fuller et al.

[11] Patent Number: 6,032,568

[45] Date of Patent: Mar. 7, 2000

[54] MEANS FOR CONTROLLING THE MUZZLE VELOCITY OF A PROJECTILE

[75] Inventors: Stephen Richard Fuller; Stephen Gilbert; Robert James Mills; Charles Davis Gareth Edwards, all of Farnborough, United Kingdom

[73] Assignee: The Secretary of State for Defence in Her Britannic Majesty's Government of the United Kingdom of Great Britain and Northern Ireland, Farnborough, United Kingdom

[21] Appl. No.: 08/959,989

[22] Filed: Oct. 29, 1997

[30] Foreign Application Priority Data

Oct. 30, 1996 [GB] United Kingdom ..... 9622615

[51] Int. Cl.[7] ..... F41F 1/00

[52] U.S. Cl. ..... 89/8; 102/202

[58] Field of Search ..... 73/167; 89/6.5, 89/8, 6; 102/202

[56] References Cited

U.S. PATENT DOCUMENTS

| | | | |
|---|---|---|---|
| 4,283,989 | 8/1981 | Toulios et al. | 89/6.5 |
| 4,483,190 | 11/1984 | Cornett | 73/167 |
| 4,590,842 | 5/1986 | Goldstein et al. | 89/8 |
| 4,837,718 | 6/1989 | Alon | 364/565 |
| 5,016,518 | 5/1991 | Kaplan et al. | 89/8 |
| 5,081,901 | 1/1992 | Kemeny et al. | 89/8 |
| 5,233,903 | 8/1993 | Saphier et al. | 89/8 |
| 5,267,502 | 12/1993 | Gent et al. | 89/14.03 |
| 5,386,759 | 2/1995 | Onozuka et al. | 89/8 |

FOREIGN PATENT DOCUMENTS

| | | |
|---|---|---|
| 1366285 | 9/1974 | United Kingdom . |
| 2287778 | 9/1995 | United Kingdom . |

*Primary Examiner*—Charles T. Jordan
*Assistant Examiner*—Jeffrey Howell
*Attorney, Agent, or Firm*—Nixon & Vanderhye P.C.

[57] ABSTRACT

A means and method of controlling the muzzle velocity of a gun launched projectile to ensure that the muzzle velocities of several rounds of the same type tend towards the same value or that of an individual round approaches some nominal value. A sensor means measures a parameter related to the muzzle velocity of a projectile and a control means instructs an electrothermal energy unit to discharge a fixed amount of energy into the gun barrel after a certain time delay, the time delay being derived from the measured parameter and being such to ensure that discharge causes the projectile to achieve a controlled muzzle velocity.

23 Claims, 1 Drawing Sheet

MEANS FOR CONTROLLING THE MUZZLE VELOCITY OF A PROJECTILE

BACKGROUND OF THE INVENTION

1. Field of the Invention

This invention relates to a means of controlling the muzzle velocity of a projectile, in particular to a means for correcting the muzzle velocity of a projectile fired from an artillery gun.

2. Discussion of the Prior Art

There is a constant military requirement to enhance the accuracy of munitions in order to increase their effectiveness and minimise collateral damage. For projectiles and the like it has been found that dispersion is often much greater in the longitudinal direction, due to discrepancies in the launch velocity, than the dispersion in the transverse direction. Thus, by correcting the deviances in range the accuracy of such munitions can be greatly increased.

One way of correcting the deviances in range is to alter the air resistance of the munition in flight in response to a deviation from some measured trajectory parameter. European Patent specification No. 0 138 942 discloses a course correction system for projectiles which measures the launch velocity, determines the impact point and relays a signal to the munition to activate a braking means on the projectile at an appropriate point. Such braking systems however require the projectile to house the braking means and also the sophisticated communication equipment reducing the available payload volume and increasing the cost of each shell. Further, such correction means always has a negative effect on range.

SUMMARY OF THE INVENTION

It is therefore an object of the present invention to provide a means for increasing the accuracy of projectiles which mitigates at least some of the above mentioned disadvantages.

Thus, according to the present invention there is provided a means for controlling the muzzle velocity of a gun launched projectile comprising a sensor means capable of measuring a parameter related to the muzzle velocity of a projectile, a control means, and an electrothermal energy unit capable of discharging a fixed amount of electrothermal energy into a gun barrel upon receipt of a trigger signal from said control means, wherein said control means introduces a delay into the transmission of the trigger signal to said electrothermal energy unit, said delay being dependent upon the measured parameter such that discharge of said fixed amount of electrothermal energy causes the projectile to achieve a controlled muzzle velocity.

Discharging electrothermal energy into the gun barrel heats the propellant gases causing an increased pressure in the barrel and therefore increases the force on the projectile. The burning rate of the propellant is also enhanced further increasing the force on the projectile. By injecting the energy at different times for different rounds the amount of work the electrothermal energy can do on the projectile can be altered. Therefore by altering the time of discharge of the electrothermal energy the amount of extra work done on the shell can be adjusted and hence the muzzle velocity achieved can be controlled. In this sense control of the muzzle velocity means that the muzzle velocities of several rounds of the same charge type could be adjusted to tend towards the same value or the muzzle velocity of a round could be increased to approach some desired value.

When consistency is required in several firings of rounds of the same type, the delay introduced will be such that discharge occurs earlier for a slower round than for a faster round. For a relatively slow round a small delay between measurement of the parameter related to the muzzle velocity and energy discharge means that the energy is discharged early along the shell's passage along the bore whereas for a relatively fast round, having a longer delay, the projectile will be nearer the muzzle when the energy is discharged. Discharging the energy earlier for the slower round ensures that the increased force due to discharge will have longer to act on the projectile than had it been a faster round. Thus the increase in muzzle velocity due to discharge of electrothermal energy will be greater for the slower round than for the faster round and in general the discharge of electrothermal energy will cause the muzzle velocities of each round to tend toward the same value.

As the same amount of electrothermal energy is discharged for each round the electrothermal energy unit can be relatively simple and the amount of energy discharged can be quite precise. Also the time delay introduced can be controlled to a high degree of accuracy, say by using electronic techniques.

Conveniently, the control means may be capable of predicting the muzzle velocity of a projectile from the measured parameter and the delay introduced into transmission of the trigger signal to the electrothermal energy unit is dependent upon the predicted muzzle velocity.

Preferably the control means is programmed with a preset value of a desired muzzle velocity and is adapted to introduce a time delay to the discharge of the electrothermal energy unit such that discharge of the electrothermal energy unit, in use, causes the actual muzzle velocity of the projectile to tend toward the preset value. The control means may also be adapted such that if the predicted muzzle velocity is equal to or greater than the preset value then the control means does not generate a trigger signal such that the electrothermal energy unit does not discharge.

Knowing the value of the muzzle velocity which the apparatus will attempt to cause a projectile to achieve increases the effectiveness of a gun system to which it is applied. The preset value of a muzzle velocity can be chosen so as to be at the top end of the range of unadjusted muzzle velocities so that some rounds, having predicted velocities near the top end of the expected range do not cause the electrothermal energy unit to discharge whereas the rounds having a predicted muzzle velocity near the bottom end of the expected range have a short delay before discharge. As the muzzle velocities are corrected upwards, a value towards the top or above the expected range of muzzle velocities is chosen so that there will be very few projectiles having a muzzle velocity greater than the preset value. Also, as the amount of energy to be discharged to achieve this goal will be relatively small, the electrothermal energy unit can be quite small.

The electrothermal energy unit may be adapted such that the fixed amount of electrothermal energy discharged can be set prior to charging. Preferably the electrothermal energy unit and control means are adapted such that the amount of energy to be discharged can be controlled via the control means.

Although preferably, a range of shells and charges would have their muzzle velocities controlled purely by control of the delay introduced, in some instances it may be necessary to control the amount of energy discharged. By varying the amount of energy discharged a greater or lesser effect on the muzzle velocity of a projectile can be achieved. This allows for the variations in round and charge types used in the gun system. The control means could be programmed with data about a range of different types of round and charge types and could adjust the amount of energy accordingly when a different combination is used. Precision could then be achieved by discharging the same amount of energy for a given charge and altering the amount when a different charge is used. Further, the amount of energy discharged could be adjusted prior to firing to account for differences in intended range. The same fixed amount of energy could be discharged for several rounds of the same type when the gun system was being used as an accurate relatively short range weapon and the amount increased when the gun is used in an extended range mode. The control means could be programmed with a range of preset values of muzzle velocities corresponding to a range of energies to be discharged. The amount of energy to be discharged is altered prior to charging in order to avoid real time switching of high voltage components.

The electrothermal energy unit conveniently comprises a pulsed power supply in order to facilitate a quick and precise discharge. It will also comprise a means for introducing the energy to the propellant gases. Means for introducing the energy to the propellant gases, such as plasma injectors or exploding wires, are well known in the art and it will be readily apparent to a worker in the field how they could be applied to this system. The electrothermal energy unit may be adapted to supply a single energy discharge, on receipt of the trigger signal or alternatively the electrothermal energy unit could be used to ignite the propellant charge and then supply a later discharge upon receipt of the trigger signal.

A convenient parameter to measure is the movement of the projectile within the barrel. The movement of the projectile within the barrel is related to the final muzzle velocity and can be measured by direct methods. A simple means of monitoring the movement of a projectile down a barrel is to have at least two sensors located on a gun barrel, each sensor being capable of detecting passage of a projectile. The passage of the projectile can then be detected in at least two places and the time delay between the registering of the passage of a projectile by each of the sensors gives an indication of the progress of the projectile. The control means can then predict the muzzle velocity from the times taken for passage of a projectile past each of the sensors.

The sensors may usefully be strain gauges adapted so as to be in contact with the gun barrel. Strain gauges affixed to a gun barrel can measure the slight expansion of the barrel caused by the travel of a projectile down the gun barrel. Strain gauges offer a simple and inexpensive method of determining passage of a projectile and may be easily attached to a gun barrel. Also, the level of strain reached can be set at any threshold value allowing for a simple signal processing arrangement. The gauges may either be adapted to lie parallel to the axis of the barrel or alternatively may be adapted to lie along at least part of the circumference of the gun barrel.

Advantageously the apparatus also comprises a means for measuring the actual muzzle velocity of a projectile and the control means is adapted such that the time delay introduced into generation of the trigger signal is also dependent upon the actual muzzle velocity measured, and the time delay introduced, for the previous round or rounds.

Thus, by measuring the actual muzzle velocity of each round the effect of the energy discharge can be gauged. The delay introduced for a predicted muzzle velocity can be compared with the actual muzzle velocity measured to ensure that the delay introduced leads to a consistent muzzle velocity for all rounds. The addition of an actual muzzle velocity measuring means also increases the effectiveness of a battery of guns each having a means for controlling the muzzle velocity as individual variations from gun to gun can be accounted for. Conveniently the way of measuring the actual muzzle velocity may comprise a radar means. Radar devices for measuring the velocities of gun launched projectiles are well known in the art and are relatively inexpensive whilst being reliable and accurate.

A further aspect of the present invention is the provision of a gun system having a means for controlling the muzzle velocity of a projectile as described above.

Such a gun system would have a precise muzzle velocity for rounds of the same type which would substantially reduce the deviations in range and increase the precision of the system without requiring expensive and complex guided munitions. Also, several such gun systems could be more efficiently used in a battery to provide accurate fire. Further the gun could be used as an extended range gun having an acceptable dispersion.

The gun system may utilise sensors capable of detecting the movement of a projectile within the barrel as described above, in which case the sensors are affixed to the outside of the barrel and separated along the axis of the gun barrel. Preferably the sensor nearest to the breech of the gun is located just after the commencement of barrel rifling.

In a further aspect of the invention there is provided a method for controlling the muzzle velocity of gun launched projectiles comprising the steps of, measuring a parameter related to the muzzle velocity of a projectile, and discharging a fixed amount of electrothermal energy into the gun barrel after a certain time delay, wherein said time delay is dependent upon said measured parameter such that discharge of said fixed amount of electrothermal energy causes the projectile to achieve a controlled muzzle velocity.

Advantageously the method comprises the additional step, after measuring the parameter related to the muzzle velocity of a projectile, of predicting the muzzle velocity of the projectile from the measured parameter and the time delay before discharge of the electrothermal energy is dependent upon the predicted muzzle velocity. Preferably the time delay is such that discharge of the electrothermal energy causes the actual muzzle velocity of the projectile to tend towards a preset value.

The parameter measured may be the movement of the projectile within the barrel.

Usefully there may be a first discharge of electrothermal energy, prior to discharge of the fixed amount of electrothermal energy, sufficient to ignite the propellant charge of a projectile.

The actual muzzle velocity of a projectile may also be measured. The time delay introduced before discharge of the fixed amount of electrothermal energy may therefore also depend upon the actual muzzle velocity measured, and time delay introduced, for a previous round or rounds.

BRIEF DESCRIPTION OF THE DRAWINGS

The invention will now be described by way of example only with reference to the following drawing in which.

DETAILED DISCUSSION OF PREFERRED EMBODIMENT

Figure 1:
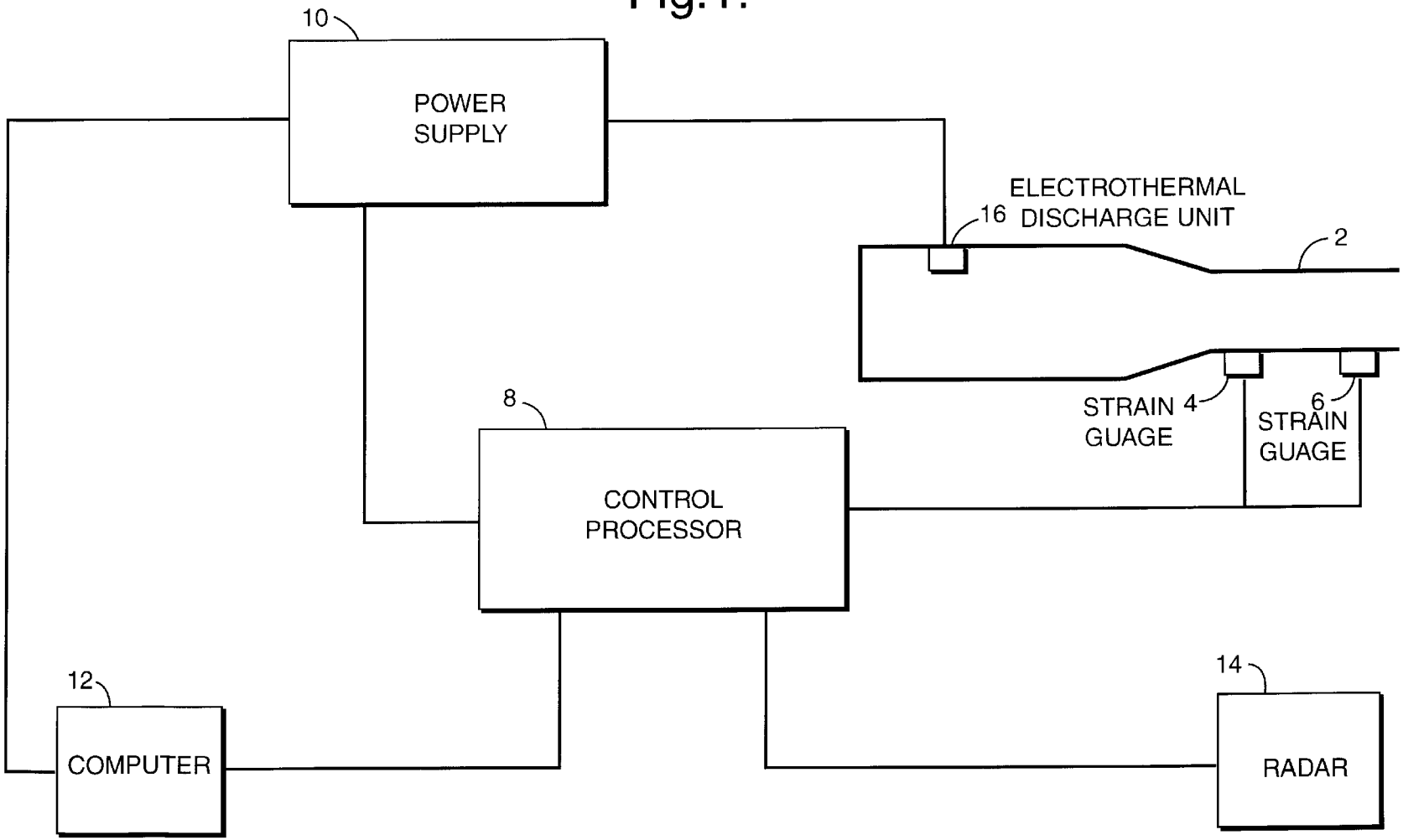
FIG. 1 shows a schematic of an embodiment of the invention utilising strain gauges as applied to an artillery gun.

Referring now to FIG. 1 the breech end of a gun barrel 2 has two strain gauges 4, 6 attached to the outside of the barrel 2. The strain gauges 4, 6 are connected to a control processor 8, which is itself connected to a pulsed power supply 10. In use, the propellant charge of a shell is ignited either by standard techniques or by discharge from the pulsed power supply 10. Ignition of the propellant charge produces propellant gases, propelling the shell down the barrel 2. Movement of the shell down the barrel 2 causes the barrel to expand at that point due to passage of the shell's driving band. This expansion is detected by both gauges 4 and 6 as an increase in the strain level past some threshold value. The actual value of strain reached is unimportant, as detection of the passage of the shell is all that is required, so long as a good signal to noise ratio is achieved. Similarly the gauges may be aligned parallel to the barrel or alternatively may be disposed as part of a loop around the barrel. The times at which each strain gauge detects passage of the shell are recorded by the control processor 8, clearly giving an indication of what the muzzle velocity would be in that a faster round will have a shorter time interval between the shell passing the first and second gauges.

The control processor 8 then determines the time delay required before discharge, via the electrothermal discharge unit 16, of the electrical energy from the pulsed power unit 10 using, for example, either a suitable algorithm or a look up table. The control processor is itself controlled by a fire control computer 12. The fire control computer 12 can be programmed with the type of charge and round to be fired and alters the time delay introduced by the control processor 8 accordingly. Other factors such as the prevailing environmental conditions or a specifically required value of muzzle velocity could also be programmed into the fire control computer 12 which would then alter the time delay introduced by the control processor 8. The amount of energy to be discharged by the pulsed power unit 10 may also be controlled by the fire control computer 12 and is set by switching charge voltages, inductors and the like, prior to firing.

The control processor 8 counts the delay required and then sends a trigger signal to the pulsed power unit 10 to discharge. If the shell's propellant charge was ignited by standard means then the pulsed power unit charges prior to firing and then discharges the preset amount of energy on receipt of the trigger signal. However, if the propellant charge was ignited by a discharge of electrothermal energy then the pulsed power unit includes a pulse forming network which generates a three part pulse. The first part would be a discharge that ignites the propellant charge. The second is fed through a large inductor causing a long sustained pulse to occur that maintains the current path in the discharge device as the shell starts its travel down the bore. The final part is the discharge of the required energy to control the muzzle velocity of the shell and is discharged upon receipt of the trigger signal.

When a round is fired but no discharge is required the pulsed power unit may either store the energy for the next round or may discharge through an alternative route. The pulsed power unit may contain capacitors as a storage medium or may employ other storage devices such as compensated pulsed alternators or disc alternators. Capacitors would be discharged if another round were not to be fired in the near future in order to avoid damage to the capacitor. Alternator devices however could store the energy for long periods.

Discharge of the electrothermal energy heats the propellant gases thus increasing the pressure in the barrel and also speeding up the combustion process. The resulting increase in force on the shell increases the acceleration and therefore the actual muzzle velocity of the shell. The time delay before discharge controls the effectiveness of the discharge. A shell near the end of its travel will only experience the increased force for a short time before exiting the barrel and so will gain a relatively small increase in its muzzle velocity. A discharge that occurs soon after the shell has passed the second strain gauge 6 will gain far more energy and its increase in muzzle velocity will be corresponding higher.

When the shell leaves the barrel the actual muzzle velocity is measured by a muzzle velocity radar 14 as is well known in the art. This value of measured muzzle velocity is then fed back to the control processor 8 to allow the intended and achieved muzzle velocities to be compared with the time delay introduced. The control processor 8 can integrate the actual measured velocities to compensate for any deviations from the expected velocity by using, for example, a neural network or Kalman filter. In this way deviation from the intended muzzle velocity such as could be caused by long term changes such as gun wear or other ageing processes can be corrected by altering the delay times. The control processor 8 can record all the data and constantly update and compensate the delay times to account for any long term changes which may occur during the life of the gun. In addition, the control processor will be able to maintain a log of the gun's entire operational life.

It will be apparent from the above that to maximise the effectiveness of the invention the range of time delays before discharge for a fast and slow round should be as great as possible. In other words, when there is no time delay required or only a very short delay, discharge should occur as early along the shells travel down the barrel as possible. The strain gauges, control processor and pulsed power unit are therefore chosen to have fast response times. How early discharge can be effected is then determined by the positioning of the gauges 4, 6 and in particular the second gauge 6. During the early stages of travel however, the shell's acceleration occurs in an irregular fashion and a prediction of muzzle velocity based on the progress of the shell during the early stages is prone to inaccuracies. The first strain gauge 4 is therefore located after the chamber shoulder and commencement of rifling. The separation of the strain gauges is therefore chosen so as to give an accurate indication of the time difference between the shell passing each strain gauge but is not so large so that discharge of the electrothermal energy can only occur in the latter stages of the shells travel.

It will be apparent that other sensors could be used to detect the movement of the shell within the barrel, for example optical detection methods using laser interferometry or sapphire windows or alternatively ultrasonic sensors, without departing from the principle of the invention. It will also be apparent to one skilled in the art that other parameters related to the muzzle velocity could be measured. For instance, the value of peak pressure in the barrel could be monitored using standard pressure gauges, the peak pressure giving an indication of the maximum force on the projectile and therefore an indication of the muzzle velocity.

We claim:

1. A means for controlling the muzzle velocity of a gun launched projectile comprising;

a sensor means capable of measuring a parameter related to the muzzle velocity of a projectile, a control means and an electrothermal energy unit capable of discharging a fixed amount of electrothermal energy into a gun barrel upon receipt of a trigger signal from said control means, wherein said control means introduces a delay into the transmission of the trigger signal to said electrothermal energy unit, said delay being dependent upon the valve of the measured parameter such that discharge of said fixed amount of electrothermal energy causes the projectile to achieve a controlled muzzle velocity.

2. A means for controlling the muzzle velocity of a gun launched projectile according to claim 1 wherein said control means is capable of predicting the muzzle velocity of a projectile from the measured parameter and wherein said time delay introduced into the transmission of a trigger signal to said electrothermal energy unit is dependent upon said predicted muzzle velocity.

3. A means for controlling the muzzle velocity of a gun launched projectile according to claim 2 wherein said control means is programmed with a preset value of a muzzle velocity and is adapted such that said time delay introduced before discharge of said electrothermal energy unit is such as to cause, in use, the actual muzzle velocity of a projectile to tend towards said preset value.

4. A means for controlling the muzzle velocity of a gun launched projectile according to claim 3 wherein said control means is adapted such that if the predicted muzzle velocity is greater than, or equal to, said preset value then said electrothermal energy unit does not discharge.

5. A means for controlling the muzzle velocity of a gun launched projectile according to claim 1 wherein said electrothermal energy unit is adapted such that the fixed amount of energy discharged can be altered prior to charging.

6. A means for controlling the muzzle velocity of a gun launched projectile according to claim 5 wherein said electrothermal energy unit and said control means are adapted such that the fixed amount of energy discharged by said electrothermal energy unit is controlled by said control means.

7. A means for controlling the muzzle velocity of a gun launched projectile according to claim 1 wherein said electrothermal energy unit comprises a pulsed power supply.

8. A means for controlling the muzzle velocity of a gun launched projectile according to claim 1 wherein said electrothermal energy unit is adapted to have a first discharge prior to discharge of said fixed amount of energy such that, in use, said first discharge ignites the propellant charge of a projectile.

9. A means for controlling the muzzle velocity of a gun launched projectile according to claim 1 wherein said sensor means measures the movement of a projectile within a gun barrel.

10. A means for controlling the muzzle velocity of a gun launched projectile according to claim 9 wherein said sensor means comprises at least two sensors locatable on a gun barrel, each sensor being capable of detecting passage of a projectile within a gun barrel, and said control means is adapted to measure the times at which each sensor detects passage of the projectile and predict the muzzle velocity of the projectile from the time difference between detection by each sensor.

11. A means for controlling the muzzle velocity of a gun launched projectile according to claim 10 wherein said sensors are strain gauges.

12. A means for controlling the muzzle velocity of a gun launched projectile according to claim 1 further comprising a means for measuring the actual muzzle velocity of a projectile wherein said control means is adapted such that the time delay introduced before discharge of said fixed amount of electrothermal energy is also dependent upon the actual muzzle velocity measured, and the time delay introduced, for a previous round or rounds.

13. A means for controlling the muzzle velocity of a gun launched projectile according to claim 12 wherein said means for measuring the actual muzzle velocity of a projectile comprises a radar device.

14. A gun system comprising a gun and the means for controlling the muzzle velocity of a projectile of claim 1.

15. A gun system comprising a gun and the means for controlling the muzzle velocity of a projectile of claim 10 wherein said sensors are affixed to the outside of the gun barrel and are separated along the axis of the gun barrel.

16. A gun system according to claim 15 wherein the gun includes a rifled barrel and the sensor nearest to the breech is located on the gun barrel after the commencement of rifling.

17. A method of controlling the muzzle velocity of a gun launched projectile comprising the steps of;

measuring a parameter related to the muzzle velocity of a projectile, and discharging a fixed amount of electrothermal energy into the gun barrel after a certain time delay, wherein the said time delay is dependent upon the value of the measured parameter such that discharge of said fixed amount of electrothermal energy causes the projectile to achieve a controlled muzzle velocity.

18. A method of controlling the muzzle velocity of a gun launched projectile as claimed in claim 17 wherein said method comprises the additional step, after measuring said parameter related to the muzzle velocity of a projectile, of predicting the muzzle velocity of the projectile from said measured parameter and wherein said time delay before discharge of the electrothermal energy is dependent upon said predicted muzzle velocity.

19. A method for controlling the muzzle velocity of a gun launched projectile according to claim 18 wherein said time delay is such that discharge of the electrothermal energy causes the actual muzzle velocity of the projectile to tend towards a preset value.

20. A method for controlling the muzzle velocity of a gun launched projectile according to claim 17 wherein said parameter measured is the movement of the projectile within the barrel.

21. A method for controlling the muzzle velocity of a gun launched projectile according to claim 17 wherein there is a first discharge of electrothermal energy, prior to discharge of said fixed amount of electrothermal energy, sufficient to ignite the propellant charge of a projectile.

22. A method of controlling the muzzle velocity of a gun launched projectile according to claim 17 wherein said parameter related to the muzzle velocity of a projectile measured is the movement of the projectile within a gun barrel.

23. A method of controlling the muzzle velocity of a gun launched projectile according to claim 17 wherein the actual muzzle velocity of the projectile is measured and said time delay introduced before discharge of said fixed amount of electrothermal energy is also dependent upon the actual muzzle velocity measured, and time delay introduced, for a previous round or rounds.

* * * * *